US012582867B2

(12) United States Patent
Pensivy

(10) Patent No.: US 12,582,867 B2
(45) Date of Patent: Mar. 24, 2026

(54) UPPER EXTREMITY REHABILITATION SYSTEM

(71) Applicant: Scott Pensivy, Las Vegas, NV (US)

(72) Inventor: Scott Pensivy, Las Vegas, NV (US)

( * ) Notice: Subject to any disclaimer, the term of this patent is extended or adjusted under 35 U.S.C. 154(b) by 44 days.

(21) Appl. No.: 18/533,464

(22) Filed: Dec. 8, 2023

(65) Prior Publication Data

US 2024/0238641 A1 Jul. 18, 2024

Related U.S. Application Data

(60) Provisional application No. 63/439,229, filed on Jan. 16, 2023.

(51) Int. Cl.

| | |
|---|---|
| ***A63B 22/00*** | (2006.01) |
| ***A63B 21/00*** | (2006.01) |
| ***A63B 21/04*** | (2006.01) |
| ***A63B 21/055*** | (2006.01) |
| ***A63B 23/12*** | (2006.01) |

(52) U.S. Cl.

CPC .... *A63B 22/0005* (2015.10); *A63B 21/00061* (2013.01); *A63B 21/00185* (2013.01); *A63B 21/0421* (2013.01); *A63B 21/0552* (2013.01); *A63B 21/4035* (2015.10); *A63B 21/4047* (2015.10); *A63B 23/1263* (2013.01); *A63B 2022/0094* (2013.01)

(58) Field of Classification Search

CPC ..... A63B 22/0005; A63B 21/00061; A63B 21/00185; A63B 21/0421; A63B 21/0552; A63B 21/4035; A63B 21/4047; A63B 23/1263; A63B 2022/0094; A63B 21/00181; A63B 23/1245; A63B 2071/026; A63B 2210/58; A63B 2225/09; A63B 2225/093; A63B 21/0557

See application file for complete search history.

(56) References Cited

U.S. PATENT DOCUMENTS

| | | | | |
|---|---|---|---|---|
| 5,759,139 | A * | 6/1998 | Wright | A63B 21/045 482/121 |
| 7,115,078 | B1 * | 10/2006 | Kalember | A63B 21/4035 482/133 |
| 7,878,956 | B2 * | 2/2011 | Kadar | A63B 23/1209 482/121 |
| 8,021,284 | B2 * | 9/2011 | Bruce | A63B 21/0087 482/148 |
| 8,636,630 | B2 * | 1/2014 | Morris | A63B 23/1209 482/117 |

(Continued)

*Primary Examiner* — Andrew S Lo
(74) *Attorney, Agent, or Firm* — Accelerate IP LLC

(57) ABSTRACT

An upper extremity rehabilitation system comprising a base with one or more pockets, a first pole and a second pole, each pole having a grip and a joint. The joint is removably attached to the pockets on the base to secure the pole from sliding. The base can have a top and a bottom with a thickness that is half or full circle. The system may also include a band spanning between the first pole and the second pole and is coupled to the poles with at least one clip. The system also includes a method of applying the system by securing the poles at a predetermined distance, choosing a band with user specified resistance, coupling the band between the poles with a clip, and instructing a user to place their hands on the grips and move the poles away from each other or in a circular motion.

15 Claims, 10 Drawing Sheets

(56) References Cited

U.S. PATENT DOCUMENTS

| | | | | |
|---|---|---|---|---|
| 11,278,760 | B1 * | 3/2022 | Hutchinson | A63B 21/4035 |
| 2004/0072663 | A1 * | 4/2004 | Ardito, III | A63B 21/16<br>482/121 |
| 2005/0176558 | A1 * | 8/2005 | Huang | A63B 21/4047<br>482/109 |
| 2008/0234116 | A1 * | 9/2008 | Elzerman | A63B 21/015<br>482/123 |
| 2011/0287907 | A1 * | 11/2011 | Morris | A63B 21/00069<br>482/117 |
| 2021/0113884 | A1 * | 4/2021 | Roberts | A63B 21/4035 |

* cited by examiner

DETAIL A

UPPER EXTREMITY REHABILITATION SYSTEM

CROSS REFERENCE

This application claims benefit from currently U.S. Provisional Application No. 63/439,229 titled "Upper Extremity Rehabilitation System" and having a filing date of Jan. 16, 2023, and all of which is incorporated by reference herein.

FIELD OF THE INVENTION

The present specification relates generally to devices for rehabilitating a user's shoulders and more specifically a device that uses multi-directional operations for rehabilitating the user's upper extremities.

BACKGROUND OF THE INVENTION

Common shoulder and rotator cuff injuries involve muscles, ligaments, and tendons. Athletes are particularly susceptible to shoulder problems and rotator cuff injuries which can develop slowly through repetitive, intensive training routines. Instability is often cause by the dislocation of one of the joints in the shoulder and impingement can be caused by excessive rubbing of the shoulder muscles where the muscles rub against the top part of the shoulder blade. Typically, treatment for these type of shoulder injuries includes a series of simple exercises aimed at strengthening the shoulder muscles including elastic tubing attached to a doorknob, wall pushups, and shoulder press-ups. Other types of treatments have been developed such as open and closed chain exercises. Closed chain exercises include machines that are fixed or stationary such as shoulder press-up.

During open-chain exercises, your hand or foot is free to move, such as when performing a triceps extension or a hamstring curl. These types of movements tend to isolate a single muscle group and a single joint. In an open-chain movement, the end of the chain farthest from the body, usually the hand or foot which moves freely and is not fixed to an object. When performing either of these exercises the user has be careful not to further injure themselves so individuals have developed specific exercises and machines to work the user's muscle or joint.

These common exercises and machines include using free weights, resistant bands and weight machines. However, most of the exercises put an unnecessary strain on the joint and muscle being rehabilitated and a lot of the time the joint or muscle needs to be moved in certain ways to help stretch and rehabilitate that certain muscle or joint. In addition, these types of machines usually allow the user to work and exercise in one way. Rehabilitation of the upper extremities, particularly after injury or surgery, often requires a series of exercises to restore strength, flexibility, and range of motion. These exercises are typically performed using various types of equipment, such as resistance bands, weights, and specialized machines. However, existing rehabilitation systems often have limitations in terms of adjustability, versatility, and user comfort.

Many current systems lack the ability to be easily adjusted to accommodate different user sizes, strengths, and specific rehabilitation needs. For instance, the distance between grips or handles may not be adjustable, which can lead to discomfort or ineffective exercises. Similarly, the resistance level provided by the system may not be easily modifiable, limiting the system's usefulness as the user's strength improves over the course of rehabilitation. Additionally, the grips or handles of many existing systems may not be designed for comfort or ease of use. This can lead to user discomfort, potentially discouraging consistent use of the system and hindering the rehabilitation process.

Therefore, there is a need for system that allows a user to effectively rehabilitate their shoulder or rotator cuff with the use of one system that allows for multiple exercises and that is that is adjustable, versatile, and designed for user comfort.

BRIEF SUMMARY OF THE INVENTION

Accordingly, the present invention is a shoulder rehabilitation system comprising a base having one or more pockets. A first pole and a second pole wherein the first pole and second pole can both comprise a first end and a second end. A first grip and a second grip which can be coupled to the first end of the first rod and the second rod. A first joint and a second joint can be coupled to the second end of the first rod and the second rod wherein the first joint and the second joint can be removably attached to the one or more pockets on the base. The first and second grip can be a ball or a ring with a handle stretching between the inner diameter of the ring.

The pockets can be a semi-spherical hole or a straight hole. The base can have a top and a bottom having a thickness that can be a half or full circle. The first joint and the second joint can be a ball and socket with a shank or another connection point. The shoulder rehabilitation system can further comprise a band wherein the band can loop around the first pole and the second pole and can be coupled to the first pole and the second pole with at least one clip. The band can be different stiffnesses.

A method of applying a shoulder rehabilitation system comprising coupling a first pole and a second pole in a pocket opposite from each other. The user can choose a band with a specified resistance. The user can place the band over the first pole and the second pole and can couple the band to the first pole and the second pole with a clip at a set distance from the first end or second end. The user can place its hands over the grip and moving the first pole and second pole away from each other or in circles as directed by a therapist or physician.

It is an advantage of the current invention to allow the user to have over fifty (50) different types of exercises for strengthening the rotator cuff and muscles of the upper glenohumeral joint, scapular area, elbows, forearms, wrist and hands.

It is an advantage of the current invention to provide resistance at a user specified resistance from no resistance to over 30 Newtons of resistance.

It is an advantage of the current invention to provide the user with different lengths, resistances, and grips to accommodate various rehabilitation techniques for the upper extremities.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor are fully aware that they can be their own lexicographers if desired. The inventor expressly elect, as their own lexicographers, to use only the plain and ordinary meaning of terms in the specification and claims unless they clearly state otherwise and then further, expressly set forth the. Absent such clear statements of intent to apply a "special" definition, it is the inventor's intent and desire that the simple, plain, and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. § 112 (f). Thus, the use of the words "function," "means" or "step" in the Detailed Description or Description of the Drawings or claims is not intended to somehow indicate a desire to invoke the special provisions of 35 U.S.C. § 112 (f), to define the invention. To the contrary, if the provisions of 35 U.S.C. § 112 (f) are sought to be invoked to define the inventions, the claims will specifically and expressly state the exact phrases "means for" or "step for" and will also recite the word "function" (i.e., will state "means for performing the function of . . . , without also reciting in such phrases any structure, material or act in support of the function. Thus, even when the claims recite a "means for performing the function of molding a . . . , step for performing the function of molding a . . . ," if the claims also recite any structure, material or acts in support of that means or step, or that perform the recited function, then it is the clear intention of the inventor not to invoke the provisions of 35 U.S.C. § 112 (f).

Moreover, even if the provisions of 35 U.S.C. § 112 (f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

Additional features and advantages of the present specification will become apparent to those skilled in the art upon consideration of the following detailed description of the illustrative embodiment exemplifying the best mode of carrying out the invention as presently perceived.

BRIEF DESCRIPTION OF THE DRAWINGS

These and other features, aspects, and advantages of the present specification will become better understood with regard to the following description, appended claims, and accompanying drawings where:

Elements and acts in the figures are illustrated for simplicity and have not necessarily been rendered according to any particular sequence or embodiment.

DETAILED DESCRIPTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Figure 1:
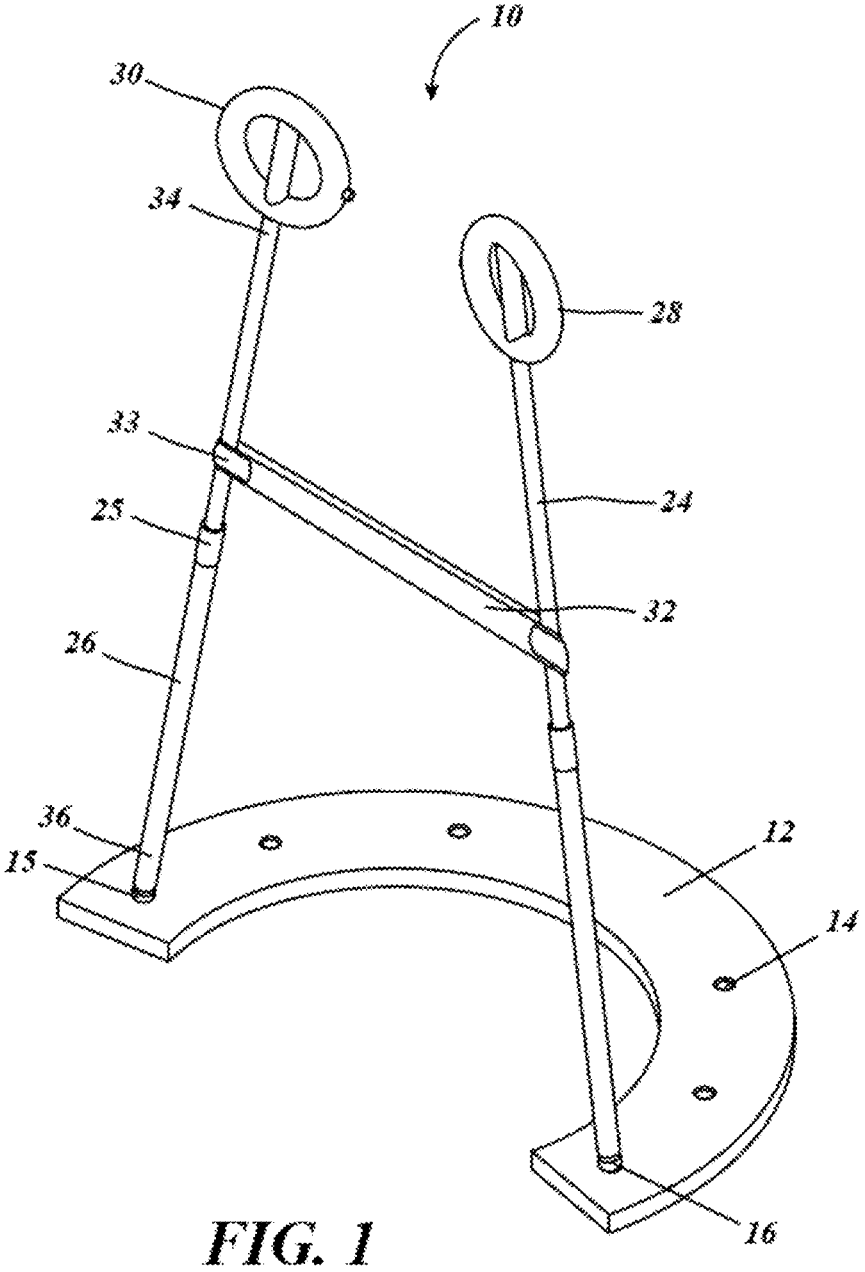
FIG. 1 is an isometric view of the shoulder rehabilitation system in accordance to one, or more embodiments.
Figure 2A:
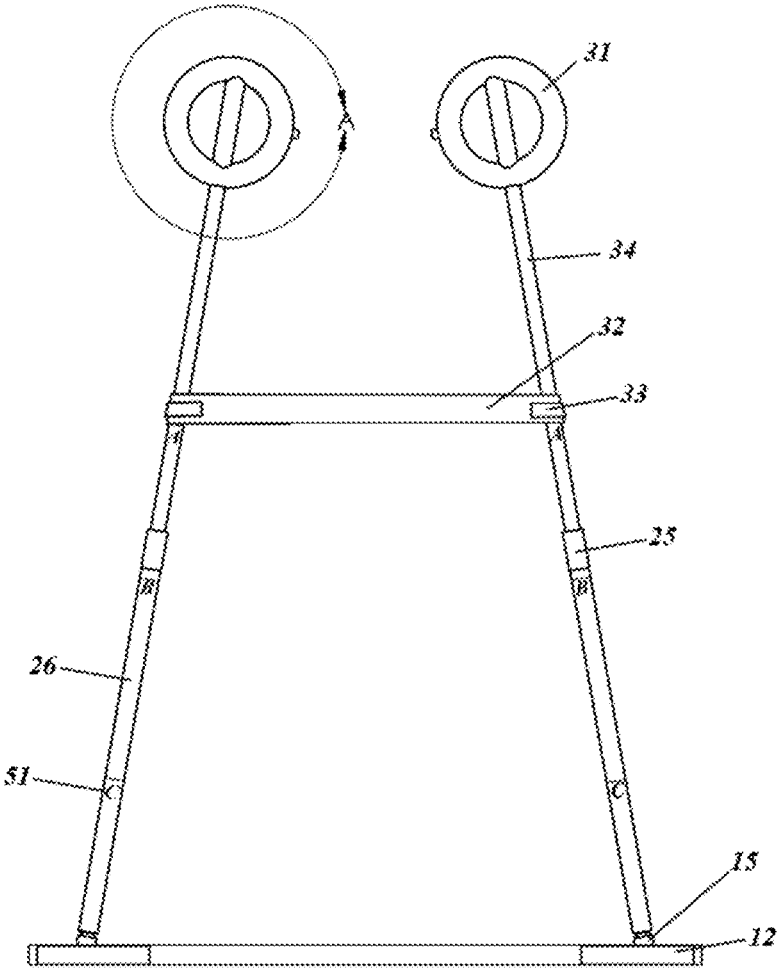
FIG. 2*a* is a front view of the shoulder rehabilitation system in accordance to one, or more embodiments.
Figure 2B:
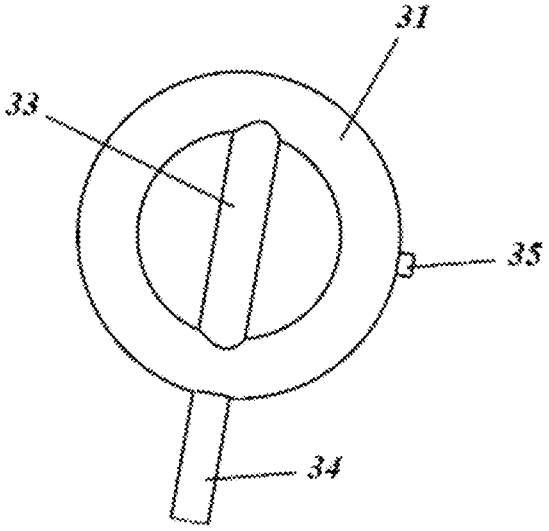
FIG. 2*b* is a closeup view of FIG. 2*a* of the shoulder rehabilitation system in accordance to one, or more embodiments.
Figure 5:
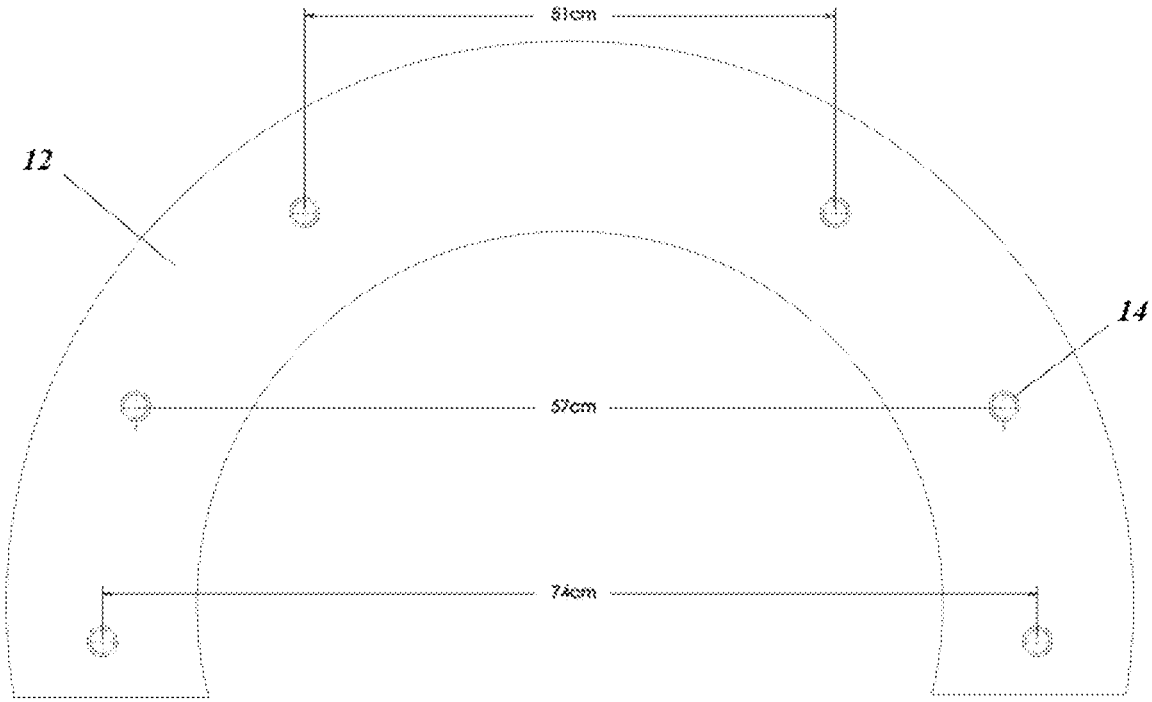
FIG. 5 is a top view of the base of the shoulder rehabilitation system in accordance to one, or more embodiments.
Figure 8:
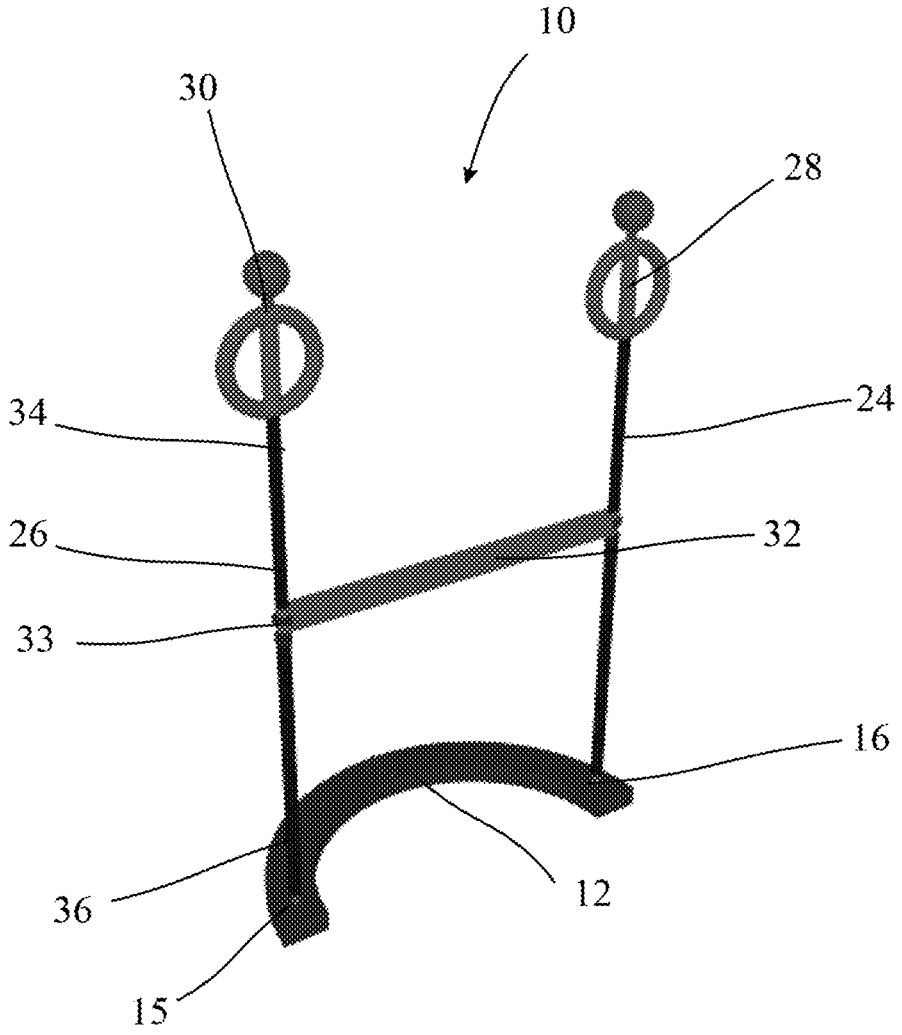
FIG. 8 is an isometric view of another embodiment of a shoulder rehabilitation system in accordance to one, or more embodiments.
Figure 9:
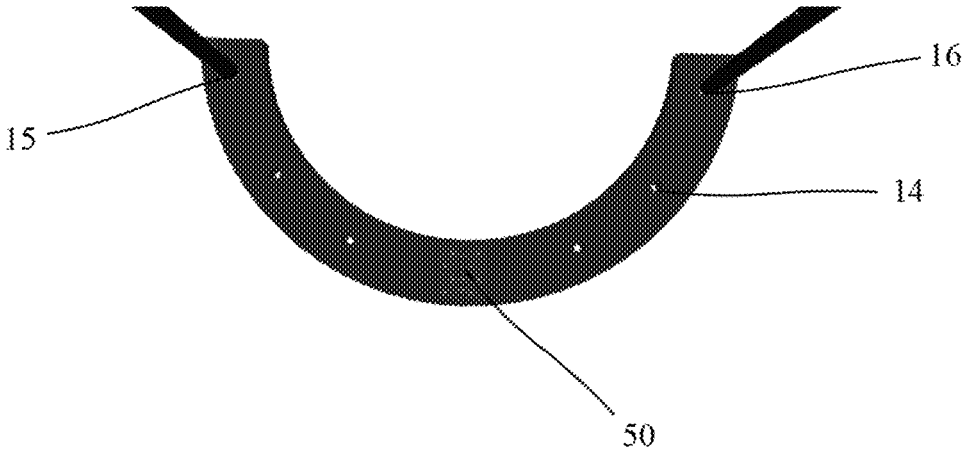
FIG. 9 is a top view of another embodiment of a shoulder rehabilitation system in accordance to one, or more embodiments.
Figure 10:
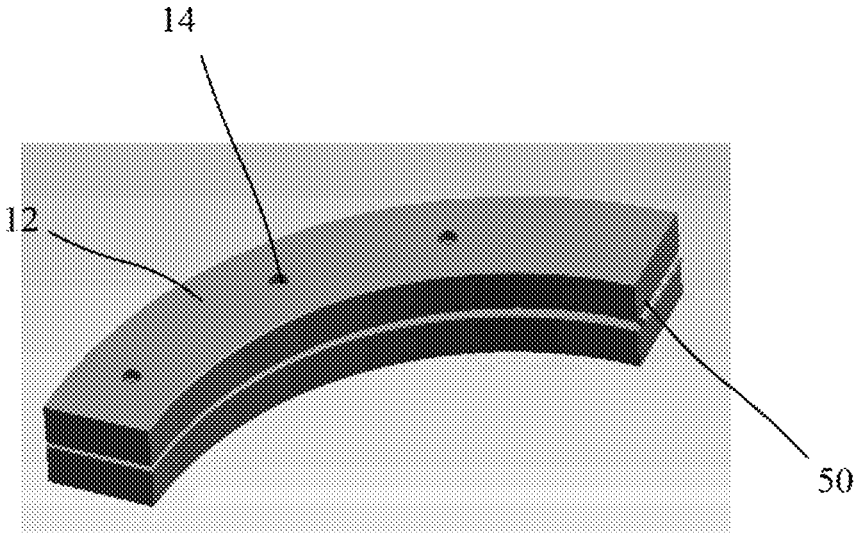
FIG. 10 is an isometric view of the base for the shoulder rehabilitation system in accordance to one, or more embodiments.
Figure 11:
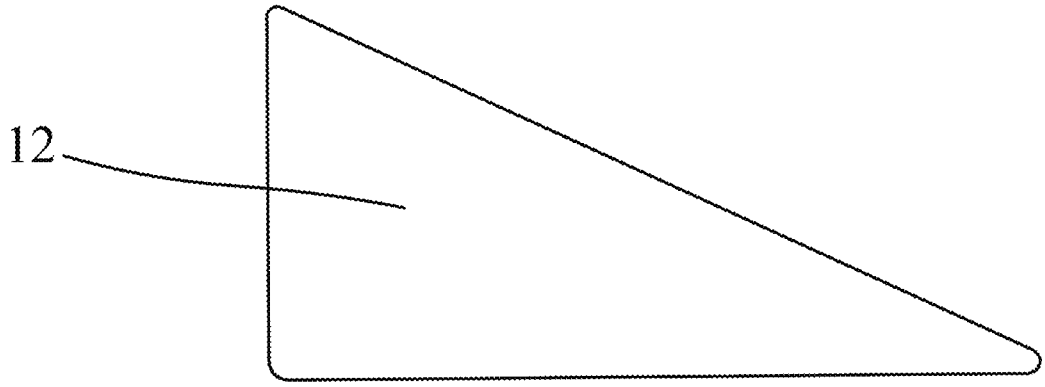
FIG. 11 is a side view of another embodiment of the base for the shoulder rehabilitation system in accordance to one, or more embodiments.

Referring initially to FIGS. 1-2 and 8, an upper extremity rehabilitation system is shown generally at 10. The upper extremity system 10 can comprise a base 12 having one or more pockets 14. The base 12 can have a top and a bottom wherein the base can have a thickness and can be in the shape of such as, for example, half or full annulus, triangular, rectangular, wedge or the like. The base 12 can be manufactured from such as, for example, wood, plastic, metal, or the like and can have a thickness wherein the base can be flat or angled as shown in FIG. 11. The one or more pockets 14 can be spaced around the base in a circular pattern and in the preferred the pockets can be spaced apart at such as at least 51 cm, at least 57 cm and at least 74 cm as shown in FIG. 5. The pockets 14 can be a semi-spherical hole, threaded hole, or the like, or in other embodiments the pockets can be omitted, and the base can have a hole drilled out with a ball and socket joint coupled to it. The base 12 can have a hinge 50 substantially in the middle of the base allowing the base to be folded in half as shown in FIGS. 9 and 10. The hinge 50 can be such as, for example, butt hinge, piano hinge, concealed hinge, two-way hinge, or the like.

The base 12 can be angled from 0 degrees to about 30 degrees. In the preferred embodiment, the angle can be at least 30 degrees with the pockets 14 spaced apart at such as at least 51 cm, at least 57 cm and at least 74 cm. The distance of the pockets on the 30-degree wedge can be at least 6 cm first hole from edge of wedge, at least 17 cm from edge of wedge, and at least 31 cm from edge of base. The pockets 14 can be for male piece of anchor system that is on the distal end of the sticks. The pockets can be numbered for a desired position, either 1, 2, or 3, in the base 12 and can be determined for what position the user is looking for the angle of the humerus and each angle of the humerus provides different muscular influence of the glenohumeral joint.

The upper extremity rehabilitation system 10 can further comprise a first pole 24 and a second pole 26 wherein both the first pole and second pole comprise a first end 34 and a second end 36. The first pole 24 and the second pole 26 can be a fixed length or an adjustable length allowing the user to adjust the length from the base for different height individuals or for different type of exercises. The user can adjust the length of the pole by moving the first end 34 side into the second end 26 side and locking it in place by a locking device 25 which can be such as for example, twist lock, snap lock, cam lock, collar clamp, pin lock or the like. The first pole 24 and second pole 26 can be a stiff or flexible pole made from such as, for example, plastic, metal, carbon, or the like. The first end 34 of the first pole 24 and the second pole 26 can be coupled to a first grip 28 and a second grip 30 wherein the grip can be coupled to the first end by such as, for example, thread, adhesive, pins, rivets, locks, snaps into the pole or the like.

Figures 6A, 6B, 6C:
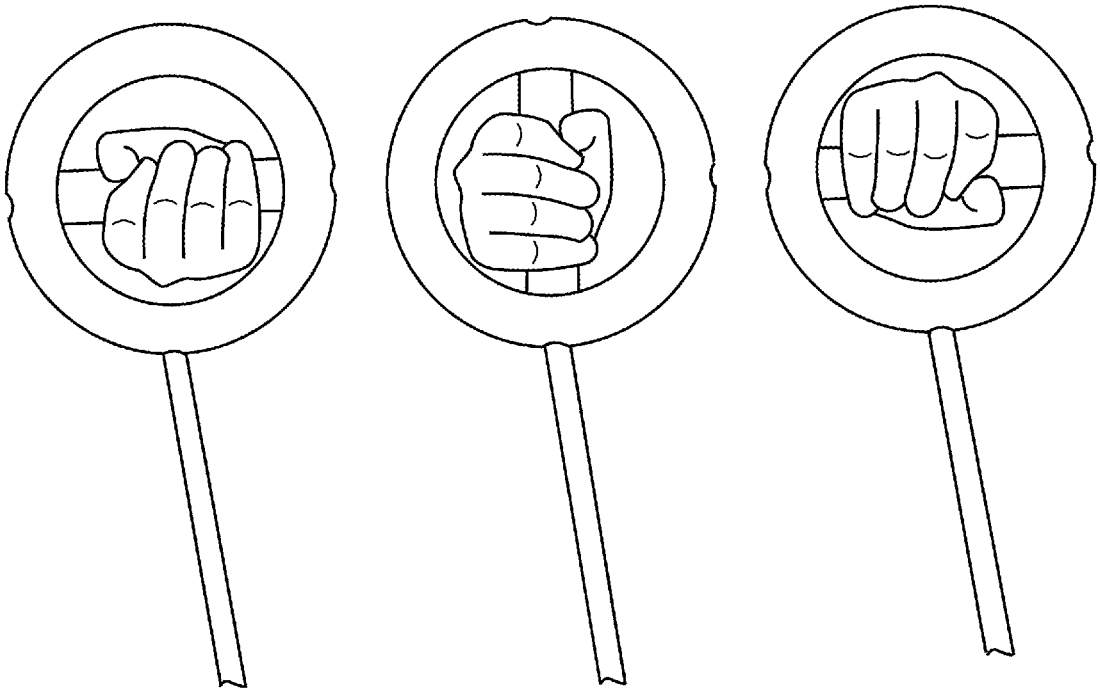
FIGS. 6*a*-6*c* is a side view of the grip in different positions of the shoulder rehabilitation system in accordance to one, or more embodiments.
Figure 7:
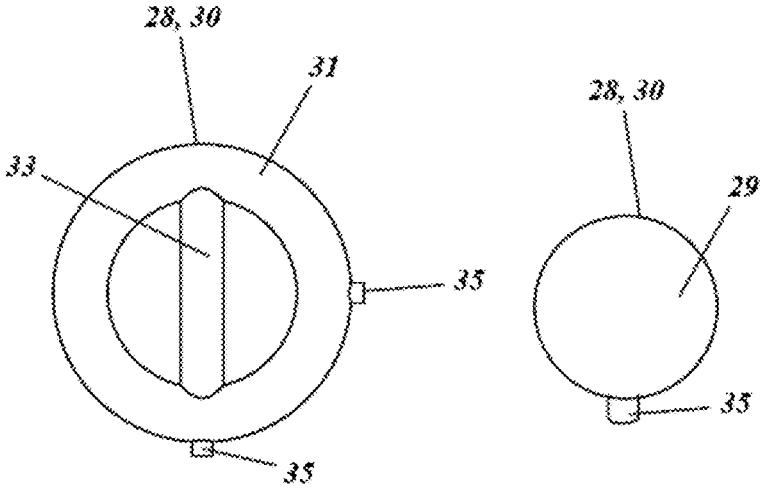
FIG. 7 is a front view of the two different types of handles for the shoulder rehabilitation system in accordance to one, or more embodiments.

The first grip 28 and the second grip 30 can be a ball with a prong 35 that can snap, thread, or be pinned into the second end 36 or in the preferred embodiment the first grip and the second grip can be a ring 31 and can be in the shape of such as, for example, an annulus, a torus, a sphere, or the like as shown in FIGS. 6-7. The first grip 28 and the second grip 30 can have a handle 33 that extends through the middle of the grip and can be coupled to the inner diameter of ring. The handle 33 can be positioned in the ring either vertically or horizontally or both on the grip. The prong 35 extending from the ring 31 can be on at least one side on the outer diameter of the ring wherein in the preferred embodiment the prong can extend from at least two sides 90 degrees apart. In certain embodiments the ball 29 and the ring 31 can be coupled together to form one handle with both a ring and ball as shown in FIG. 8. In embodiments, the prong 35 can be such as, for example, a protrusion, or a hole wherein the protrusion can be removably or permanently coupled by such as, for example, thread, adhesive, weld, snaps, pins, or the like onto or into the first end 34. In certain embodiments, the first grip 28 and the second grip 30 can be movable or stationary on the first end 34 or it can be set at different angles from the first pole 24 and the second pole 26.

Figure 3:
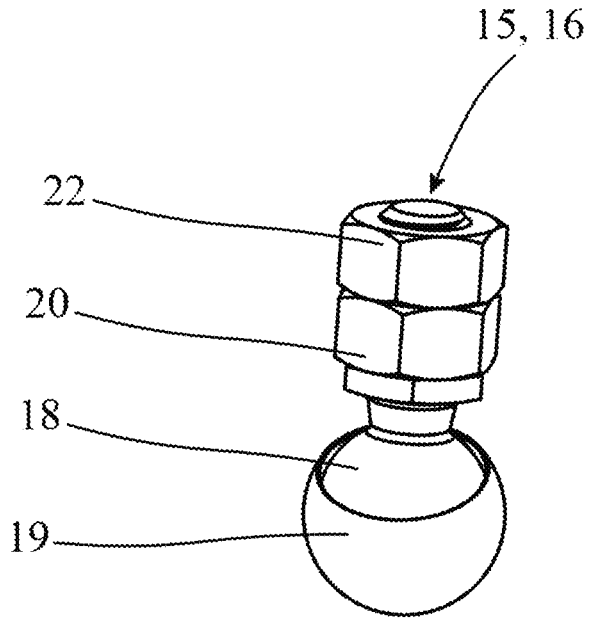
FIG. 3 is a front view of the pivot point for the shoulder rehabilitation system in accordance to one, or more embodiments.
Figure 4:
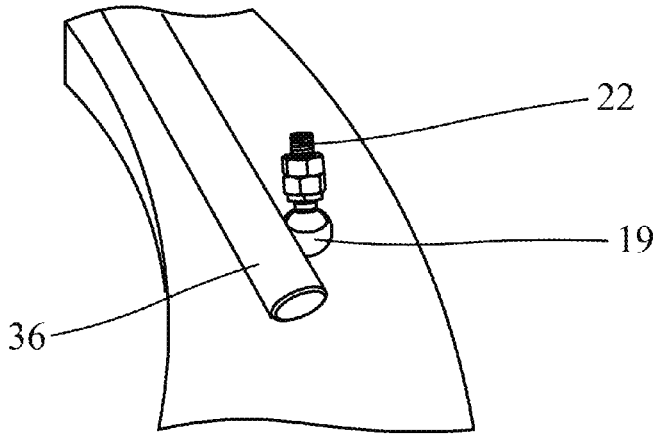
FIG. 4 is a partial isometric view of the shoulder rehabilitation system in accordance to one, or more embodiments.

In embodiments, the first pole 24 and the second pole's 26 second end 36 can be removably or permanently coupled to a joint which can be a first joint 15 and a second joint 16. Referring to FIG. 3 the first joint 15 and the second joint 16 can comprise a ball 18 and a socket 19 joint wherein the first joint and the second joint can be removable or permanently attached to the one or more pockets 14 on the base wherein in certain embodiment the ball can have a shaft coupled to it and can be inserted into the pocket. In certain embodiments, the first joint 15 and the second joint 16 can further comprise at least one nut 20 and a shank 22 which can be threaded or unthreaded. The shank 22 can be removably or permanently coupled to the second end 36 by such as, for example, threaded, press fit, loose fit, adhesive or the like as shown in FIG. 4. The socket 19 can contact the pockets 14 and can allow the user to move or rotate the grips 28, 30 and the first pole 24 and second pole 26 within the pockets 14. In certain embodiments, the socket 19 can be inserted into the pockets 14 by such as, for example, threads, press fit, loose fit or the like where the socket can be removed from one pocket and inserted into another pocket.

Referring back to FIGS. 1-2, the upper extremity rehabilitation system 10 can further comprise a band 32. The band 32 can be such as, for example, elastic, rubber, resistance bands, compact bands or the like. The band 32 can wrap around the first pole 24 and the second pole 26 or it can be coupled to the first pole and the second pole by at least one clip 33. The user can adjust where the band 32 sits on the first pole 24 and the second pole 26 allowing the user to adjust the resistance of the band 32 between the first pole 24 and the second pole 26. The band 32 can be different levels resistant levels such as, for example, between at least 1-Newton to at least 200-newtons wherein the user can increase or decrease the resistance between the first pole 24 and the second pole 26 as the user moves the two poles apart from each other.

In the preferred embodiment, the first pole 24 and the second pole 26 can have at least three locations marked on the first pole and the second pole for the band 32 and clip 33 to be placed wherein each position is marked with a number or letter and each location can provide such as, for example, 10 Newtons of resistance, 20-Newtons of resistance, 30-Newtons of resistance, or the like as shown in FIG. 7. Each resistance area can be at least 20 cm apart from one another with the first area 15 cm from most distal end of the superior area of the first pole 24 and the second pole 26. In other embodiments, the user can add more than one band 32 onto the first pole 24 and the second pole 26 increasing the resistance through adding bands.

A method of applying an upper extremity rehabilitation system comprising coupling a first pole and a second pole in a pocket opposite from each other at a set length. Choosing a band with a user specified resistance. Placing the band over the first pole and the second pole and coupling the band to the first pole and the second pole with a clip at a set distance from the first end or second end. A user placing its hands over the grip and moving the first pole and second pole away from each other or around in circles. In embodiments, there can be 9 adjustable positions from at least 2 feet to at least 5 feet.

Once the height has been determined by using the adjustable sticks, the user can use this device as a warm-up product by not using any resistance which can be done by placing the hands on the grip which can be a ball 29 or ring 31 as shown in FIG. 7. For example, the ball 29 can allow for a full forearm position only and can be a starting point. The ring 31 handle can be designed to give the individual the option of exercising the forearm in a neutral position, a full supinated position, or a full pronated position as shown in FIGS. **6*a*-6*c*, which allows the user to isolate the muscles for the desired exercise. The positions of the forearm with activate different muscle groups up the kinetic chain of the upper extremities. The first pole 24 and the second pole 26 can be fastened by a first joint 15 and a second joint 16 that allows for a distal ball and socket motion to mimic the glenohumeral joint ball and socket as shown in FIGS. 1 and 3. Once the first pole 24 and the second pole 26** are at the desired and fixed height, the individual can start the exercise program, which can be a clockwise exercise, counterclockwise exercise, sagittal and frontal or transverse planar motion. It also can mimic a flexion, extension, internal and external, or shoulder adduction and abduction and horizontal shoulder abduction and adduction.

Once the individual's shoulders are warmed up, one can take the first band 32 of 10 Newtons and place it over the first pole 24 and the second pole 26. The first pole 24 and the second pole 26 can have three areas of identified areas of A, B, or C, 51, to place the band for resistance in a desired plane as shown in FIG. 2*a*. A position is the most resistance area that one can place the resistance band. B will be the second least, and C will be the least amount of resistance on the 10-Newton band provided. The resistance changes because of the physical lever system that is provided from the joint 15 to the grip 28. Once the individual decides where the loop will go for resistance, it is placed over the first pole 24 and the second pole 26 and two clips 33 will clip the band 32 into the position on each of the poles, whether it will be A, B, or C, and will be noted. These clips 33 allow for a fasten devices so bands do not migrate superior or inferior on the stick, first pole 24 and the second pole 26 when the resistance is challenged. These positions of A, B, and C are designed for documentation to demonstrate progression or no progression. As a user gets stronger, the progression will go from C to B to A. A is the strongest resistance position on the poles.

As the user uses the first pole 24 and the second pole 26 with the resistance, they can add another 10-Newton resistance band and can add additional bands up to at least three 10-Newton loops can be provided and positioned at A, B, or C with the appropriate clips 33. Each resistance area is 20 cm apart from one another with the A area 15 cm from most distal end of the superior area of the first pole 24 and the second pole 26.

A method of applying an upper extremity rehabilitation system comprising securing a first pole having a first grip and a second pole having a second grip at a predetermined distance from each other. The user can choose a band with a user specified resistance. The band can be coupled between the first pole and the second pole with a clip at a set distance from the first end or second end. Instructing a user to place a firsthand on the first grip and a second hand on the second grip and move the first pole and second pole away from each other or in a circular motion.

In closing, it is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular methodology, protocol, and/or reagent, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only and is not intended to limit the scope of the present disclosure, which is defined solely by the claims. Accordingly, embodiments of the present disclosure are not limited to those precisely as shown and described.

Certain embodiments are described herein, including the best mode known to the inventors for carrying out the methods and devices described herein. Of course, variations on these described embodiments will become apparent to those of ordinary skill in the art upon reading the foregoing description. Accordingly, this disclosure includes all modifications and equivalents of the subject matter recited in the claims appended hereto as permitted by applicable law. Moreover, any combination of the above-described embodiments in all possible variations thereof is encompassed by the disclosure unless otherwise indicated herein or otherwise clearly contradicted by context.

What is claimed is:

1. An upper extremity rehabilitation system comprising:
- a base having a plurality of pockets spaced around the base in a circular pattern;
- a first pole and a second pole, each pole comprising:
  - a first end and a second end;
  - a grip coupled to the first end; and
  - a joint coupled to the second end wherein the joint is configured to removably attach to each of the one or more pockets on the base to secure the pole from sliding relative to the base.

2. The upper extremity rehabilitation system according to claim 1, wherein the grip is a ball above a ring with a handle stretching between an inner diameter of the ring.

3. The upper extremity rehabilitation system according to claim 1, wherein the grip is a ring with a handle stretching between an inner diameter of the ring and the ring is coupled to the first end by at least one attachment point on the ring allowing for the handle to be selectively vertical or horizontal.

4. The upper extremity rehabilitation system according to claim 1, wherein the pockets are a semi-spherical hole.

5. The upper extremity rehabilitation system according to claim 1, wherein the base has a top and a bottom having a thickness that is half or full circle.

6. The upper extremity rehabilitation system according to claim 1, wherein the joint is a ball and socket with a shank.

7. The upper extremity rehabilitation system according to claim 1, further comprising a band configured to span between the first pole and the second pole and couple to the first pole and the second pole with at least one clip.

8. The upper extremity rehabilitation system according to claim 7, wherein the band is a resistance band.

9. The upper extremity rehabilitation system according to claim 7, wherein the at least one clip couples to the first pole and the second pole at a predetermined distance from the first end or second end.

10. The upper extremity rehabilitation system according to claim 1, wherein the plurality of pockets is a first set of opposite pockets, a second set of opposite pockets, and a third set of opposite pockets, and wherein the first set of opposite pockets are spaced 51 cm apart, the second set of opposite pockets are spaced 57 cm apart, and the third set of opposite pockets are spaced 74 cm apart.

11. The upper extremity rehabilitation system according to claim 1, wherein each of the first pole and the second pole has at least one identified area to place a band for resistance.

12. The upper extremity rehabilitation system according to claim 1, further comprising a hinge in the base.

13. The upper extremity rehabilitation system according to claim 1, wherein the base is angled.

14. The upper extremity rehabilitation system according to claim 13, wherein the angle of the base is 30 degrees.

15. A method of applying a upper extremity rehabilitation system comprising the acts of:
- providing a base having a plurality of pockets spaced around the base in a circular pattern;
- securing a first pole having a first grip in a first pocket of the plurality of pockets and a second pole having a second grip in a second pocket of the plurality of pockets at a predetermined distance from each other, wherein each of the first pole and the second pole has at least one identified area;

choosing a band with a user specified resistance;

coupling the band between the first pole and the second pole with the band placed in one of the at least one identified areas; and instructing a user to place a first hand on the first grip and a second hand on the second grip and move the first pole and second pole away from each other or in a circular motion.

* * * * *